US012773089B2

(12) United States Patent
Hammond et al.

(10) Patent No.: US 12,773,089 B2
(45) Date of Patent: Oct. 27, 2026

(54) DISH TREATING APPLIANCE WITH REMOTE PUMP

(71) Applicant: WHIRLPOOL CORPORATION, Benton Harbor, MI (US)

(72) Inventors: Richard L. Hammond, Mattawan, MI (US); Chandler A. Longley, Benton Harbor, MI (US); Emily J. Phillips, St. Joseph, MI (US); Jason R. Spears, St. Joseph, MI (US); Elliott V. Stowe, Stevensville, MI (US); Evan J. Wahl, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 79 days.

(21) Appl. No.: 18/921,363

(22) Filed: Oct. 21, 2024

(65) Prior Publication Data

US 2026/0108130 A1 Apr. 23, 2026

(51) Int. Cl.
*A47L 15/44* (2006.01)
*A47L 15/42* (2006.01)

(52) U.S. Cl.
CPC ..... *A47L 15/4418* (2013.01); *A47L 15/4209* (2016.11)

(58) Field of Classification Search
CPC ..... A47L 15/4418
See application file for complete search history.

(56) References Cited

U.S. PATENT DOCUMENTS

| | | | |
|---|---|---|---|
| 5,839,454 | A | 11/1998 | Matz |
| 7,571,734 | B2 | 8/2009 | Kappler et al. |
| 7,845,361 | B1 | 12/2010 | Verespej et al. |
| 8,381,744 | B2 | 2/2013 | Classen |
| 8,696,828 | B2 | 4/2014 | Classen et al. |
| 12,150,612 | B2 | 11/2024 | Stowe |
| 2005/0126607 | A1 | 6/2005 | Haft et al. |
| 2006/0254626 | A1 | 11/2006 | Botts et al. |
| 2014/0352744 | A1 | 12/2014 | Shintani |

FOREIGN PATENT DOCUMENTS

| | | | |
|---|---|---|---|
| CN | 110215174 | A | 9/2019 |
| CN | 113057559 | A | 7/2021 |
| CN | 114376490 | A | 4/2022 |
| DE | 102006043916 | A1 | 3/2008 |
| EP | 0860141 | A2 | 8/1998 |
| EP | 4272622 | A1 | 11/2023 |

OTHER PUBLICATIONS

European Patent Office, Extended European Search Report Re: Corresponding Application No. 25206006.6-1015, dated Mar. 10, 2026, 8 pages, Munich, Germany.

*Primary Examiner* — Jason Y Ko
(74) *Attorney, Agent, or Firm* — Price Heneveld LLP

(57) ABSTRACT

A dish treating appliance having a chassis defining a treating chamber with a door assembly and a dispenser assembly operably coupled to the door assembly. The dispenser assembly having a cartridge receptacle defining a cartridge seat for carrying a cartridge assembly and at least one fluid coupling for coupling to a pump and a motor to drive the pump. The pump and motor being disposed remote from the dispenser assembly for pumping detergent from the detergent cartridge into the treating chamber.

20 Claims, 7 Drawing Sheets

DISH TREATING APPLIANCE WITH REMOTE PUMP

BACKGROUND

Contemporary household appliances such as a dishwasher can have a chemistry treating dispensing system for automatically dispensing one or more treating chemistries at an appropriate time during a cycle of operation. Locating the electronics and electrical connections associated with these dispensing systems can be challenging as they can be subject to the harsh conditions of a dish treating operating cycle.

BRIEF DESCRIPTION

In one aspect the disclosure relates to a dish treating appliance for treating articles according to an automatic cycle of operation. The dish treating appliance has a chassis with an interior surface at least partially defining a treating chamber for receiving articles for treatment according to the automatic cycle of operation. The chassis includes a door assembly having an inner door surface forming part of the interior surface of the chassis, a dispenser assembly operably coupled to the interior surface comprising a cartridge receptacle defining a cartridge seat for carrying a cartridge assembly and at least one fluid coupling having a first end configured to couple to the cartridge, and at least one pump and at least one motor to drive the pump. The at least one pump and at least one motor can be disposed remote from the dispenser assembly. The at least one pump is coupled to a second end of the fluid coupling for pumping detergent from the detergent cartridge into the treating chamber.

In another aspect the disclosure relates to a dish treating appliance for treating articles according to an automatic cycle of operation. The dish treating appliance having a chassis with an interior surface at least partially defining a treating chamber for receiving the articles for treatment according to the automatic cycle of operation, the chassis including a door assembly having an inner door surface forming part of the interior surface of the chassis, a dispenser assembly operably coupled to the interior surface comprising a cartridge receptacle defining a cartridge seat for carrying a cartridge assembly and at least one fluid coupling having a first end configured to couple to the cartridge, and a dispenser outlet positioned in a location remote from the dispenser assembly.

DETAILED DESCRIPTION

Figure 1:
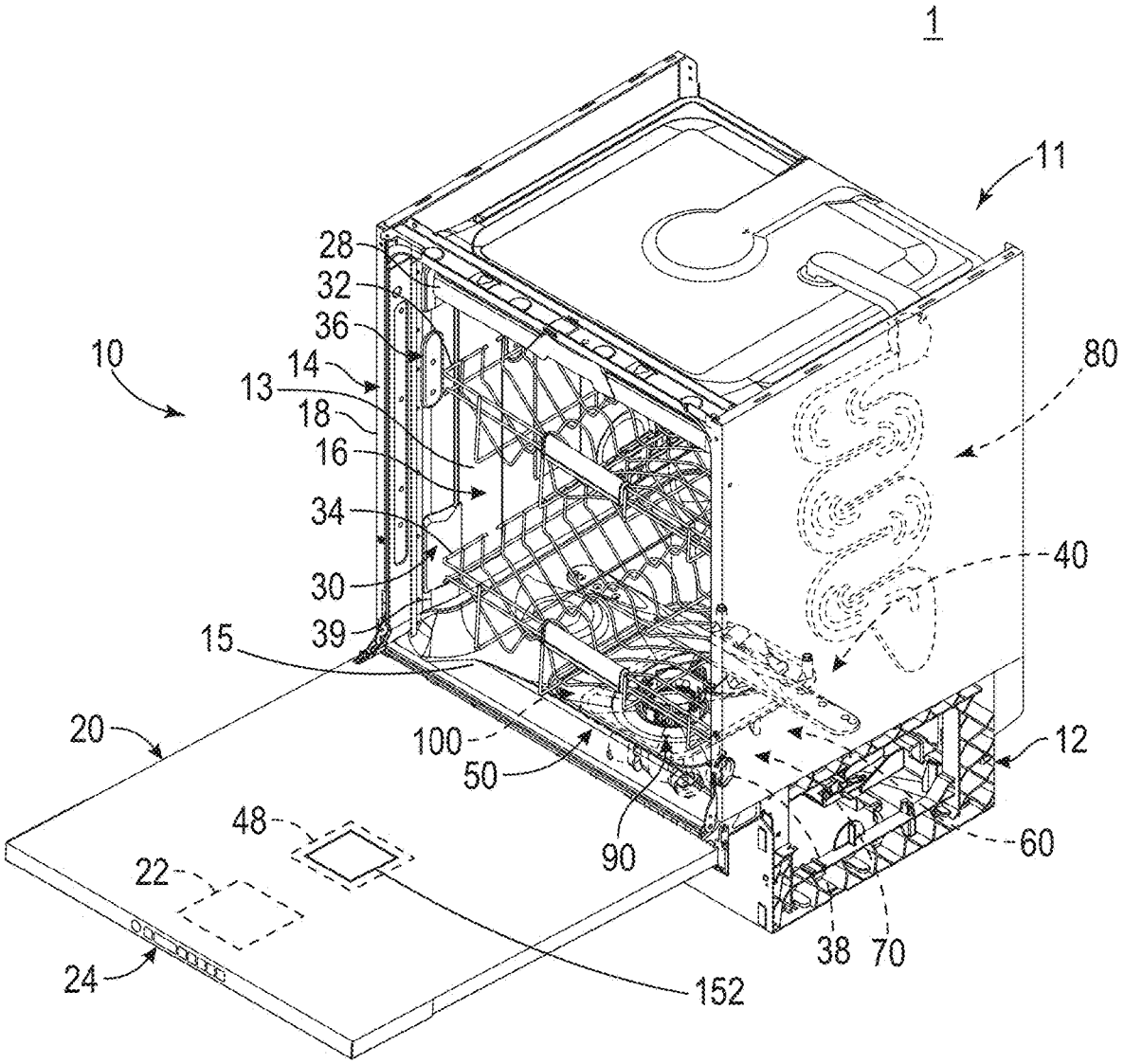
FIG. 1 is a right-side perspective view of an exemplary household appliance in the form of an automatic dishwasher having multiple systems for implementing an automatic cycle of operation.

Treating chemistry dispenser assemblies may utilize cartridge assembly dispensers. One type of cartridge assembly is a bulk cartridge assembly, which may contain one or more treating chemistry reservoirs with enough treating chemistry (multiple charges or multiple doses) for multiple cycles. Cartridge assemblies with one or more cartridges are utilized to dispense one or more treating chemistries during a cycle of operation of a household appliance such as a dish treating appliance or dishwasher or a washing machine. In some instances, the pumps and motors that pump the treating chemistry from reservoirs of the cartridge assembly to the treating chamber are located in the cartridge receptacle that houses the cartridge assembly. However, such a proximate location can have the disadvantage of subjecting the pump or motor to water leaks if the cartridge receptacle sealing system fails. Accordingly, it may be advantageous to locate the pumps and motors remote from the dispensing system. It may also be advantageous to locate the dispenser outlet remote from the dispenser assembly.

Features, advantages, and aspects of the present disclosure are set forth or apparent from a consideration of the following detailed description, drawings, and claims. Moreover, the following detailed description is exemplary and intended to provide explanation without limiting the scope of the disclosure as claimed.

As used herein, the terms "first," "second," "third," "fourth," or the like can be used interchangeably to distinguish one component from another and are not intended to signify location or importance of the individual components. In addition, the singular forms "a," "an," and "the" include plural references unless the context clearly dictates otherwise.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, secured, fastened, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order, and relative sizes reflected in the drawings attached hereto can vary.

Additionally, as used herein, a "controller" or "controller module" can include a component configured or adapted to provide instruction, control, operation, or any form of communication for operable components to effect the operation thereof. A controller module can include any known processor, microcontroller, or logic device, including, but not limited to: field programmable gate arrays (FPGA), an application specific integrated circuit (ASIC), a proportional controller (P), a proportional integral controller (PI), a proportional derivative controller (PD), a proportional integral derivative controller (PID controller), a hardware-accelerated logic controller (e.g. for encoding, decoding, transcoding, etc.), or the like, or a combination thereof. Non-limiting examples of a controller module can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based on one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types.

FIG. 1 illustrates an exemplary household appliance 1 capable of implementing an automatic cycle of operation for treating articles. The household appliance 1 can include any suitable appliance such as a dishwasher, a steam treatment appliance, a clothes washer, a clothes dryer, a combination washer/dryer, or the like, in non-limiting examples.

In the illustrated example, the household appliance 1 is in the form of a dishwasher 10 for treating dishes. As used in this description, the term "dish(es)" or "dish item(s)" is intended to be generic to any item, single or plural, that can be treated in the dishwasher 10, including, without limitation, dishes, plates, pots, bowls, pans, glassware, or silverware. As illustrated, the dishwasher 10 is a built-in dishwasher implementation, which is designed for mounting under a countertop. However, this description is applicable to other dishwasher implementations such as a stand-alone, drawer-type, or a sink-type, for example.

The dishwasher 10 has a variety of systems, some of which are controllable, to implement the automatic cycle of operation. A chassis 11 is provided to support the variety of systems for implementing the automatic cycle of operation. The chassis 11 includes an interior surface 13 that at least partially defines a treating chamber 16. The treating chamber 16 includes an open face for receiving the dishes 18. As illustrated, for a built-in implementation, the chassis 11 includes a frame in the form of a base 12 and an open-faced tub 14 supported on the base 12. The open-faced tub 14 includes a tub surface 15 at least partially defining the treating chamber 16. The chassis 11 includes a closure in the form of a door assembly 20. The door assembly 20 is pivotally mounted to the base 12 for movement between opened and closed positions to selectively open and close the open face of the treating chamber 16, such as for loading and unloading of dishes or other items. The door assembly 20 includes an inner door surface 21 at least partially defining the treating chamber 16. In this manner, the interior surface 13 can include at least one of the tub surface 15 or the inner door surface 21.

The chassis 11, as in the case of the built-in dishwasher implementation, can be formed by portions of the dishwasher 10, like the tub 14 and the door assembly 20, in addition to a dedicated frame structure, like the base 12, with them all collectively forming a unibody frame to which the variety of systems are supported. In other implementations, such as a drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis 11, while essentially limitless, can include a dish holding system 30, a spray system 40, a recirculation system 50, a drain system 60, a water supply system 70, a drying system 80, a heating system 90, and a filter system 100. These systems are used to implement one or more treating cycles of operation for the dishes, for which there are many, and one of which includes a traditional automatic wash cycle.

A basic automatic wash cycle of operation has a wash phase, where a detergent/water mixture is recirculated and then drained, which is then followed by a rinse phase where water alone or with a rinse agent is recirculated and then drained. An optional drying phase can follow the rinse phase. The automatic wash cycle can have multiple wash phases and multiple rinse phases. The multiple wash phases can include a pre-wash phase where water, with or without detergent, is sprayed or recirculated on the dishes, and can include a dwell or soaking phase. There can be more than one pre-wash phase. A wash phase, where water with detergent is recirculated on the dishes, follows the pre-wash phase(s). There can be more than one wash phase; the number of which can be sensor controlled based on the amount of sensed soils in the wash liquid. One or more rinse phases can follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry, or any combination thereof.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis 11. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of an upper dish rack 28 and a lower dish rack 34, referred to as "racks", which are located within the treating chamber 16. The upper dish rack 28 and the lower dish rack 34 are typically mounted for slidable movement in and out of the treating chamber 16 through the open face for ease of loading and unloading. Drawer guides, which can include slides or rails 36, can be used to slidably mount the upper dish rack 28 to the tub 14. The lower dish rack 34 can have wheels or rollers 38 that roll along rails 39 formed in sidewalls of the tub 14 and onto the door assembly 20 when the door assembly 20 is in the opened position.

Dedicated dish holders can also be provided. One such dedicated dish holder is a third-level rack 33 located above the upper dish rack 28. Like the upper dish rack 28, the third-level rack is slidably mounted to the tub 14 with rails 36. The third-level rack 33 can be used to hold utensils, such as tableware, spoons, knives, spatulas, etc., in an on-the-side or flat orientation. However, the third-level rack 33 is not limited to holding utensils. If an item can fit in the third-level rack 33, it can be washed in the third-level rack 33. The third-level rack 33 generally has a much shorter height or lower profile than the upper and lower dish racks 28, 34. The height of the third-level rack 33 can be short enough that a typical glass cannot stand vertically in the third-level rack 33 within the treating chamber 16.

Another dedicated dish holder can be a silverware basket (not shown), which is typically carried by one of the upper or lower dish racks 28, 34 or mounted to the door assembly 20. Such a silverware basket can hold utensils and the like in an upright orientation as compared to the on-the-side or flat orientation of the third-level rack 33.

A dispenser assembly 48 is provided to dispense treating chemistry (e.g., detergent, anti-spotting agent, etc.) into the treating chamber 16. The dispenser assembly 48 can dispense one or more types of treating chemistries. The dispenser assembly 48 can be a single-use dispenser or a bulk dispenser, or a combination of both.

The dispenser assembly 48 is operably coupled to the interior surface 13 of the treating chamber 16. In the illustrated example, the dispenser assembly 48 is coupled to the inner door surface 21 though this need not be the case. The dispenser assembly 48 can also be coupled to the tub surface 15 in some implementations. It is also contemplated that multiple dispenser assemblies 48 can be provided, including on the inner door surface 21, the tub surface 15, or a combination thereof.

Figure 2:
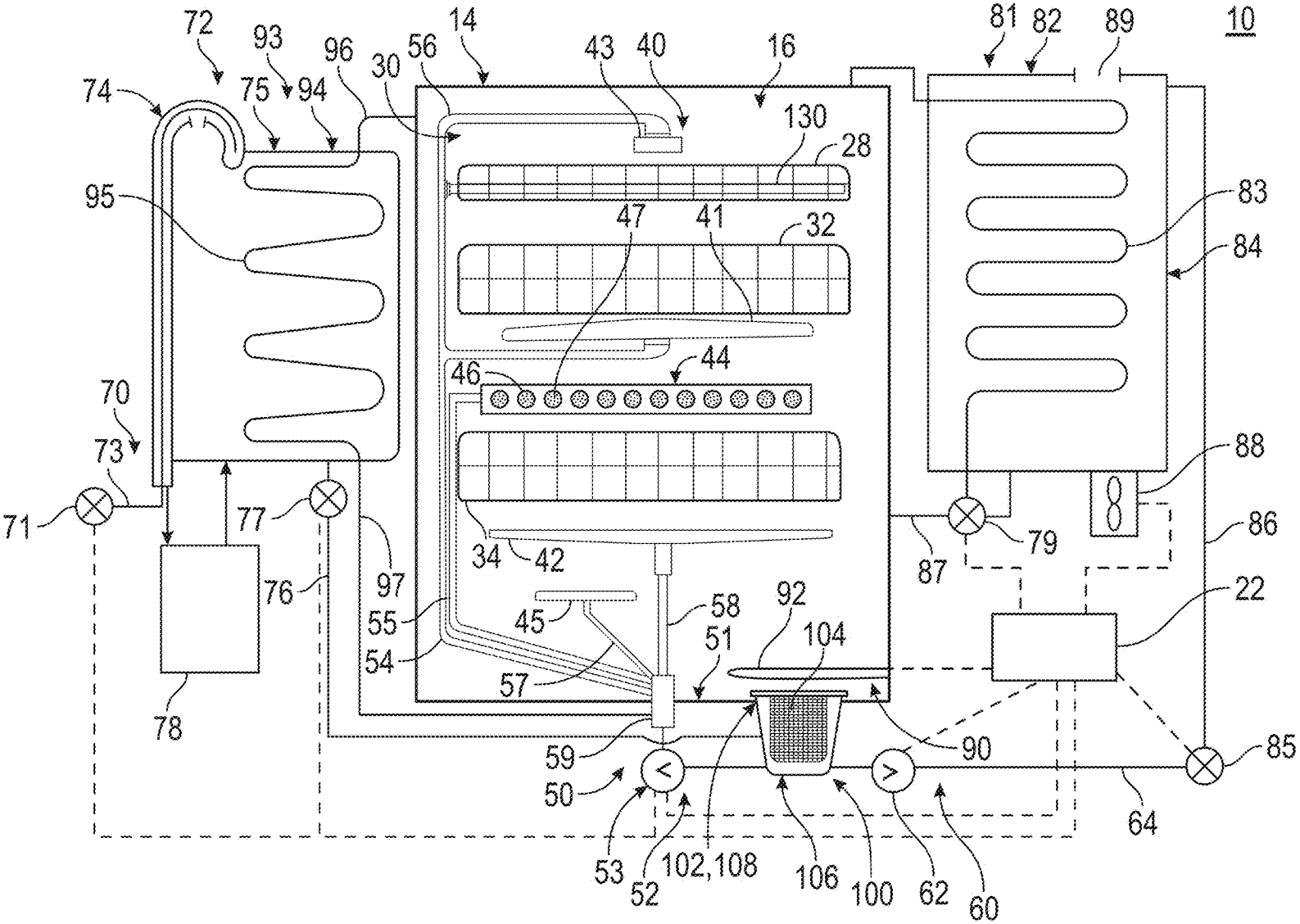
FIG. 2 is a schematic view of the household appliance of FIG. 1 illustrating some exemplary plumbing and electrical connections between at least some of the multiple systems.

Turning to FIG. 2, the spray system 40 is provided for spraying liquid in the treating chamber 16 and can have a set of spray assemblies or sprayers 41-45, 130, some of which can be dedicated to a particular one of the dish holders, to a particular area of a dish holder, to a particular type of cleaning, or to a particular level of cleaning, etc. The set of sprayers 41-45, 130 can be fixed or movable, such as rotating, relative to the treating chamber 16 or dish holder. Six exemplary sprayers are illustrated in the set of sprayers 41-45, 130 and include an upper spray arm 41, a lower spray arm 42, a third level sprayer 43, a deep-clean sprayer 44, a spot sprayer 45, and a tube sprayer 130. The upper spray arm 41 and lower spray arm 42 are rotating spray arms, located below the upper dish rack 28 and lower dish rack 34, respectively, and rotate about a generally centrally located and vertical axis. The third level sprayer 43 is located above the third-level rack 33. The third level sprayer 43 is illustrated as being fixed, but could move, such as by rotating. In addition to the third level sprayer 43 or in place of the third level sprayer 43, the tube sprayer 130 can be located at least in part below a portion of the third-level rack 33. The tube sprayer 130 is illustrated as a fixed tube, carried by the third-level rack 33, but could be movable, such as by rotating about a longitudinal axis.

The deep-clean sprayer 44 is a manifold extending along a rear wall of the tub 14 and has multiple nozzles 46, with multiple apertures 47, generating an intensified and/or higher-pressure spray than the upper spray arm 41, the lower spray arm 42, or the third level sprayer 43. The nozzles 46 can be fixed or move, such as by rotating. The spray emitted by the deep-clean sprayer 44 defines a deep clean zone, which, as illustrated, would be disposed along a rear side of the lower dish rack 34. Thus, dishes for deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below, or beside any of the dish holders where deep-cleaning is desired.

The spot sprayer 45, like the deep-clean sprayer, can emit an intensified and/or higher-pressure spray, especially to a discrete location within one of the dish holders. While the spot sprayer 45 is shown below the lower dish rack 34, it could be adjacent any part of any dish holder or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as by rotating.

The upper spray arm 41, the lower spray arm 42, the third level sprayer 43, the deep-clean sprayer 44, the spot sprayer 45, and the tube sprayer 130 are illustrative examples of suitable sprayers and are not meant to be limiting as to the type of suitable sprayers in the set of sprayers 41-45, 130.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recessed portion of a bottom wall of the tub 14. The pump assembly 52 can include one or more pumps such as a recirculation pump 53. The sump 51 can also be a separate module that is affixed to the bottom wall and include the pump assembly 52.

Multiple liquid supply conduits 54, 55, 56, 57, 58 fluidly couple the set of sprayers 41-45, 130 to the recirculation pump 53. A recirculation valve 59 can selectively fluidly couple each of the conduits 54-58 to the recirculation pump 53. While each sprayer 41-45, 130 is illustrated as having a corresponding dedicated supply conduit 54-58 one or more subsets, comprising multiple sprayers from the total group of sprayers 41-45, 130 can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54-58 can be directly coupled to the recirculation pump 53, while one or more of the other conduits 54-58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated the drain pump 62 fluidly couples the sump 51 to the drain line 64.

While separate recirculation and drain pumps 53, 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 can be more robust than the recirculation pump 53 as the drain pump 62 tends to have to remove solids and soils from the sump 51, unlike the recirculation pump 53, which may recirculate liquid which has solids and soils filtered away to some extent.

The water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

The drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, the recirculation system 50, the drain system 60, or the water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way, a fluid circuit is formed by the drain pump 62, the drain line 64, the valve 85, the supply conduit 86, the cooling tank 84, the return valve 79, and the return conduit 87 through which liquid can be supplied from the treating chamber 16 to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of or in addition to cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air can be used when the cooling tank 84 is not filled with liquid. Advantageously, the use of cooling air or cooling water, or combination of both, can be selected according to the site-specific environmental conditions. If ambient air is cooler than the cold water temperature, then the ambient air can be used. If the cold water is cooler than the ambient air, then the cold water can be used. Energy efficiency and/or cost-effectiveness can also be taken into account when selecting one or both of cooling air or cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

The heating system 90 is provided for heating water used in the cycle of operation. The heating system 90 includes a heater 92, such as an immersion heater, located in the treating chamber 16 at a location where it will be immersed in the water supplied to the treating chamber 16. The heater 92 need not be an immersion heater. The heater 92 can also include an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As various wash phases use liquid that is heated by the heater 92, this heated liquid can then be recirculated through the heating circuit 93 to transfer the heat to the charge of water in the supply tank 75, which can be used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
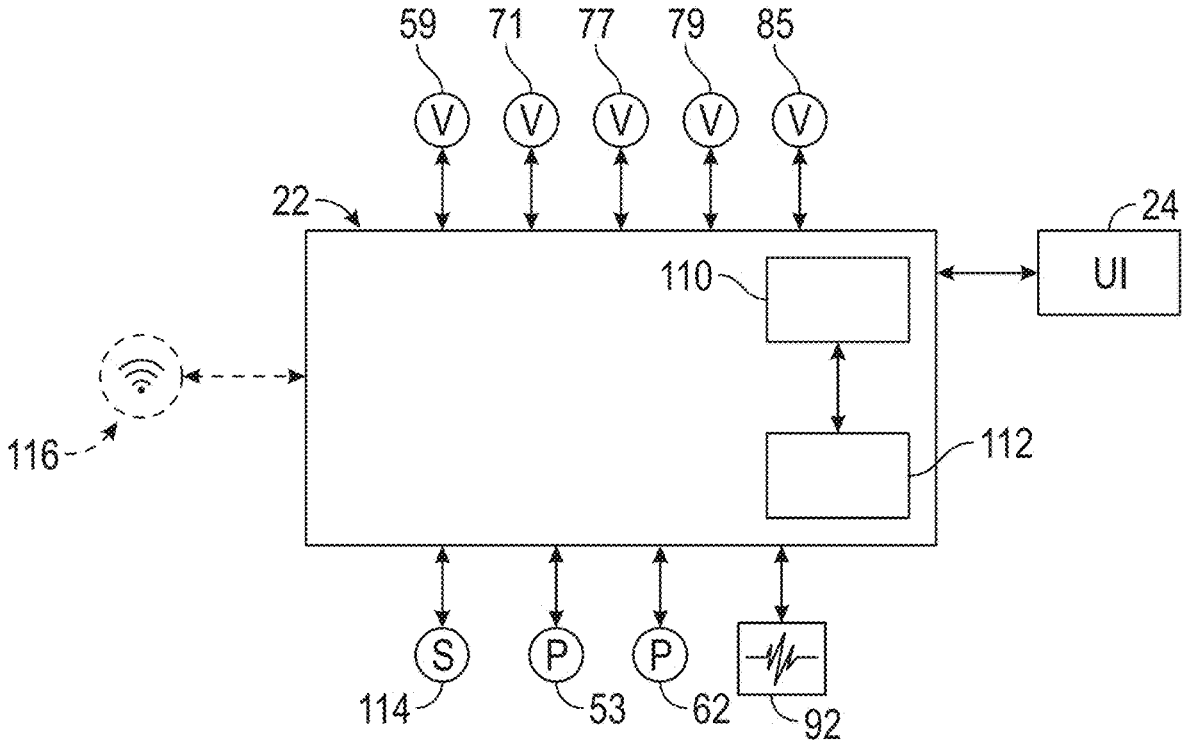
FIG. 3 is a schematic view of a controller of the household appliance of FIG. 1.

As illustrated schematically in FIG. 3, the controller 22 can be coupled with the heater 92 for heating the wash liquid during a cycle of operation, the drain pump 62 for draining liquid from the treating chamber 16 (FIG. 2), and the recirculation pump 53 for recirculating the wash liquid during the cycle of operation. The controller 22 can be provided with a memory 110 and a processor, such as a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, but are not limited to, an ambient air temperature sensor, a treating chamber temperature sensor, a water supply temperature sensor, a door open/close sensor, and a turbidity sensor. A turbidity sensor may determine the soil load associated with a selected grouping of dishes, such as the dishes associated with a particular area of the treating chamber 16. The controller 22 can also communicate with the recirculation valve 59, the household water valve 71, the controllable valve 77, the return valve 79, and/or the valve 85. Optionally, the controller 22 can include or communicate with a wireless communication device 116.

While the non-limiting embodiment shown in FIGS. 1-3 is described and illustrated with various features and components, other embodiments can include subsets of those features and components. For example, some embodiments may not include tanks 75, 84, a water softener 78, and/or a heat exchanger 94, among other features and components.

Figure 4:
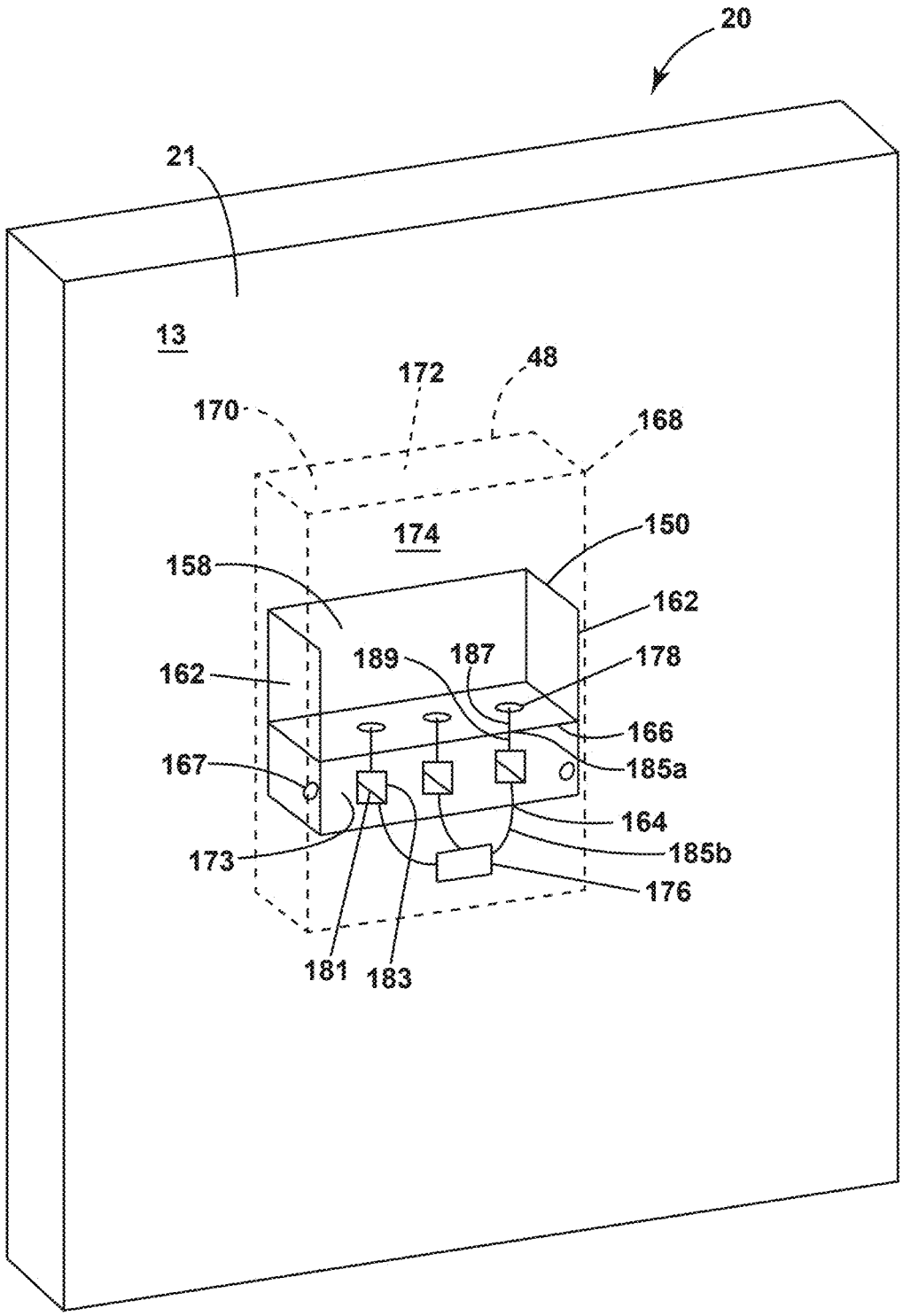
FIG. 4 is a schematic perspective view of a dispenser assembly in the household appliance of FIG. 1 in accordance with various aspects described herein.
Figure 5:
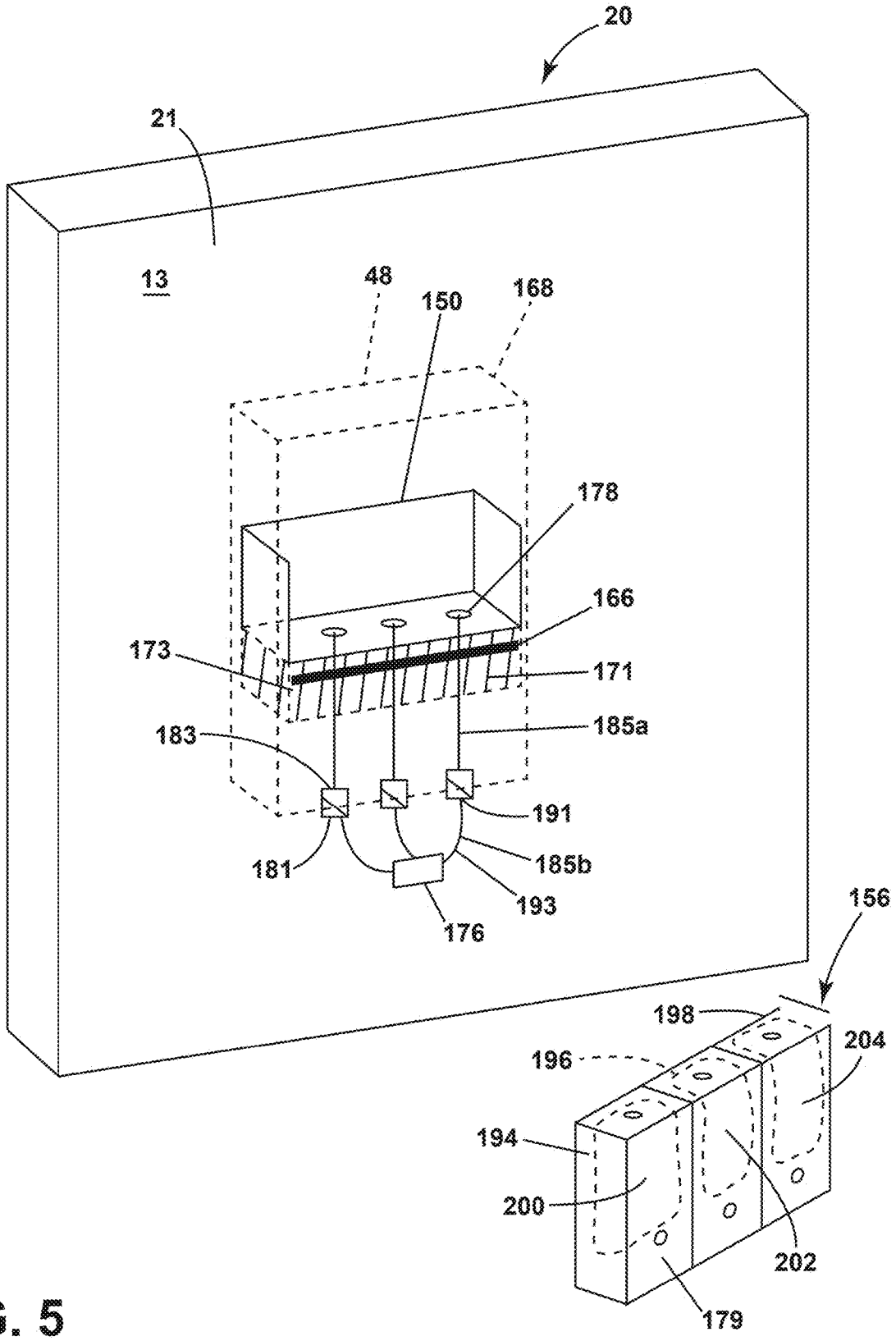
FIG. 5 is a schematic perspective view of a dispenser assembly in the household appliance of FIG. 1 in accordance with various aspects described herein and illustrating schematic cartridge assembly exploded therefrom.

FIGS. 4 and 5 illustrate a schematic of a portion of the door assembly 20 showing the dispenser assembly 48 in accordance with various aspects described herein. The dispenser assembly 48 can comprise a dispenser recess 168 and a cartridge receptacle 150. The cartridge receptacle 150 can be configured to be mounted or housed in the dispenser recess 168. For purposes of illustration, FIGS. 4 and 5 show the dispenser recess 168 to be significantly larger than the cartridge receptacle 150. It should be realized that the dispensed recess 168 and cartridge receptacle 150 could be closely sized for the cartridge receptacle 150 to be mounted or housed within the dispensed recess 168. It should also be noted that the cartridge receptacle 150 and dispenser recess 168 could also be integrally formed with the door assembly 20.

In an aspect, the dispenser recess 168 can be positioned on the interior surface 13 of the inner door surface 21. The dispenser recess 168 can include a rear wall 170 and a peripheral wall 172. The peripheral wall 172 extends from the rear wall 170 and defines an open face 174 opposite the rear wall 170. The dispenser recess 168 is contemplated to at least partially receive the cartridge receptacle 150. It should be recognized that the dispenser recess 168 is not confined to being positioned on the inner door surface 21 and could be positioned on any surface forming part of the treating chamber 16 (FIG. 1).

The cartridge receptacle 150 can comprise a rear wall 158, two side walls 162, a base wall 164, and a cartridge seat 166. A cover 152 (see FIG. 6) can be provided opposite the rear wall 158 to close the cartridge receptacle 150. A suitable cartridge receptacle and cover may be found in U.S. patent application Ser. No. 18/524,532, filed Nov. 30, 2023, now U.S. Pat. No. 12,65,034, entitled "Dishwasher," which is incorporated herein by reference in its entirety.

The cover 152 can couple to the cartridge receptacle 150 in any number of ways such that that the cartridge receptacle 150 and the cover 152 are movable relative to each other. In the aspect shown, one of the cover 152 or the cartridge receptacle 150 can carry pivot pins 165 that project into apertures 167 in the other of the cover 152 or the cartridge receptacle 150 to allow pivotal movement between the cover 152 and the receptacle 150. Movement of the cover 152 relative to the cartridge receptacle 150 allows access to an interior of the cartridge receptacle 150. The cartridge assembly 156, as will be further described below, can be at least partially inserted into the cartridge receptacle 150 and be supported by the cartridge seat 166. The cartridge assembly 156 is shown exploded from the door assembly 20. The cartridge assembly 156 can be accessed by a user and be removable and replaceable in the cartridge receptacle 150.

A fluid connection port 178 can be included in the cartridge receptacle 150. In non-limiting examples, the cartridge receptacle 150 can include a plurality of fluid connection ports 178, such as for a number of treating chemistries that can be dispensed from a cartridge assembly 156. The fluid connection ports 178 can be positioned in the cartridge receptacle 150, at the cartridge seat 166. The cartridge seat 166 can be situated in the cartridge receptacle 150 near, or, in an exemplary configuration, above the base wall 164, forming a gap 173 between the cartridge seat 166 and base wall 164. The fluid connection ports 178 are also configured to couple with one or more fluid outlet ports 179 of the cartridge assembly 156. For instance, either or both of the fluid connection port 178 or the fluid outlet port 179 can include a piercing end 197 (see FIG. 6), a cannula, a membrane, a press-fit connector, a valve, or the like. In this way, when a user inserts a cartridge assembly 156 into the cartridge receptacle 150, the treating chemistries in the cartridge assembly 156 are in fluid communication with the fluid connection ports 178.

As illustrated in FIG. 4, one or more pumps 181 and/or motors 183 can be provided in the gap 173. The one or more pumps 181 can be in fluid communication with the fluid connection port or ports 178. Moreover, the one or more motors 183 can be provided to drive the one or more pumps 181. In the illustrated example, there are provided three pumps 181 and three motors 183, a pump 181 and a motor 183 for the number of treating chemistries that can be dispensed from the cartridge assembly 156. Each pump 181 can be fluidly coupled, via a fluid conduit 185*a*, to each fluid connection port 178. Each fluid conduit 185*a* can have a first end 187 fluidly connected to a fluid connection port 178 and second end 189 fluidly connected to an inlet on the pump 181.

One advantage of providing the one or more pumps 181 and one or more motors 183 in the gap 173 in the dispenser assembly 48 is the close proximity of the pump 181 to the fluid connection port 178. However, there can also be disadvantages to providing the one or more pumps 181 and one or more motors 183 in the gap 173 in the dispenser assembly 48. One disadvantage is inability to completely fill the gap 73 with insulation if the one or more pumps 181 and one or more motors 183 are present. Another disadvantage is that with the one or more pumps 181 and one or more motors 183 being inside of the dispenser assembly 48 within the dishwasher door assembly 20, the one or more pumps 181 and one or more motors 183 are potentially exposed to water leaks if the dispenser assembly 48 sealing system fails.

Due to some of the disadvantages, it is contemplated that the one or more pumps 181 and one or more motors 183 can be provided remote from the cartridge receptacle 150 as shown in FIG. 5. In other words, the one or more pumps 181 and one or more motors 183 can be provided outside the confines of the dispenser assembly 48. In this exemplary configuration, the gap 173 can be provided with insulation 171. Insulation 171 can be provided around and in portions of the cartridge assembly 150 to thermally insulate the chemistries and/or detergents in the cartridge assembly 156 from the temperature changes that occur during a wash cycle. Insulating the chemistries and/or detergents in the cartridge assembly 156 from high wash cycle temperatures can help maintain the quality of chemistries and/or detergents. Thereby, increasing the number of wash cycles the dish treating appliance 10 can run with chemistries in the cartridge assembly 156. In the event insulation 171 is provided the gap 173 and the pumps 181 and motors 183 are provided remote from the dispenser assembly, a cannula support 166 can be provided in the gap 173 to hold the piercing end 197 of the fluid ports 178 in place.

In either non-limiting example shown in FIG. 4 or 5, a dispenser outlet 176 can be provided on the inner door surface 21. The dispenser outlet 176 fluidly couples to the fluid connection port 178, via the one or more pumps 181, such as by a fluid conduit 185*b* or the like. Each fluid conduit 185*b* can have a first end 191 fluidly coupled to a pump 181 and a second end 193 fluidly coupled to the dispenser outlet 176 for dispensing treating chemistries from the cartridge assembly 156 to the treating chamber 18.

The cartridge assembly 156 can comprise a first cartridge 194, a second cartridge 196, and a third cartridge 198, which has been schematically shown in this figure for clarity. The cartridge assembly 156 can include at least one treating chemistry reservoir for containing any suitable amount of treating chemistry, including a single dose or charge, or multiple or bulk doses or charges. In the non-limiting example shown, the first cartridge 194 includes a first treating chemistry reservoir 200, the second cartridge 196 includes a second treating chemistry reservoir 202, and the third cartridge 198 includes a third treating chemistry reservoir 204. It is contemplated that each of the first treating chemistry reservoir 200, the second treating chemistry reservoir 202, and the third treating chemistry reservoir 204 include different types of treating chemistry, however, that need not be the case.

At least one fluid outlet port 179 on the cartridge assembly 156 is fluidly coupled to each of the first treating chemistry reservoir 200, the second treating chemistry reservoir 202, and the third treating chemistry reservoir 204. The fluid outlet port 179 can extend or project from the cartridge assembly 156 or can also be positioned along or within the cartridge assembly 156 in some implementations. In the non-limiting example shown, the cartridge assembly 156 includes a fluid outlet port 179 for each of the corresponding reservoirs; however, there could be a single outlet port for multiple reservoirs. In this way, when a user inserts a new cartridge assembly 156 into the cartridge receptacle 150, the treating chemistries in the cartridge assembly 156 are in fluid communication with the fluid outlet ports 179, which are in fluid communication with connection ports 178, which are in fluid communication with the dispenser outlet 176.

Figure 6:
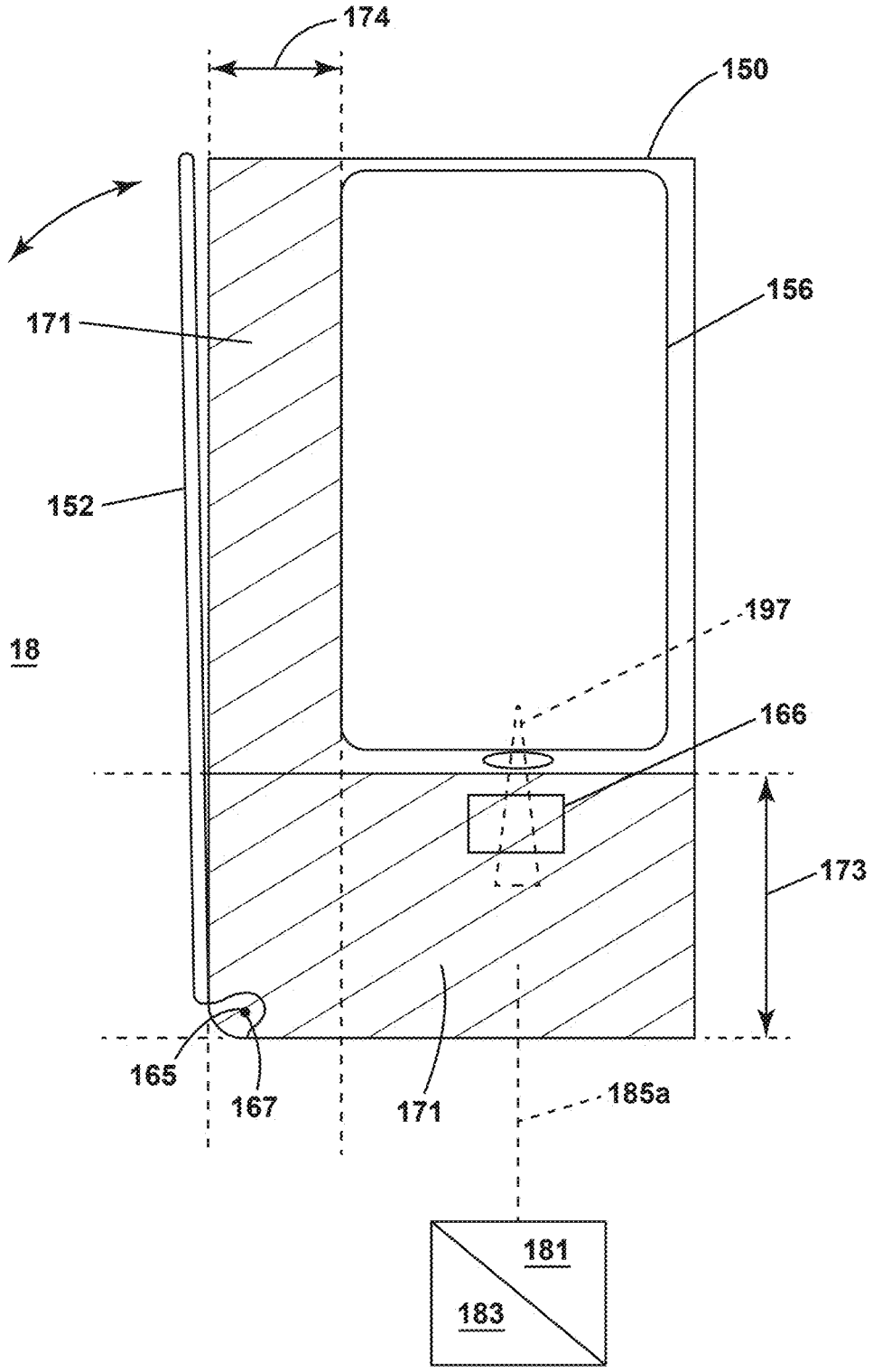
FIG. 6 is a schematic side view of the dispenser assembly of FIG. 4 according to various aspects described herein.

FIG. 6 shows a possible insulation configuration of the cartridge receptacle 150 if the one or more pumps 181 and one or motors 183 are located remotely from the dispenser assembly 48. In this example, when the cover 152 is in a closed position, a cover gap 174 is formed between the cover 152 and cartridge assembly 156. Insulation 171 can be provided in the gap 173 also and can also be provided in the gap 171. In this way, the cartridge assembly 156 can be almost completely insulated from the temperature changes that occur during a wash cycle.

Figure 7A:
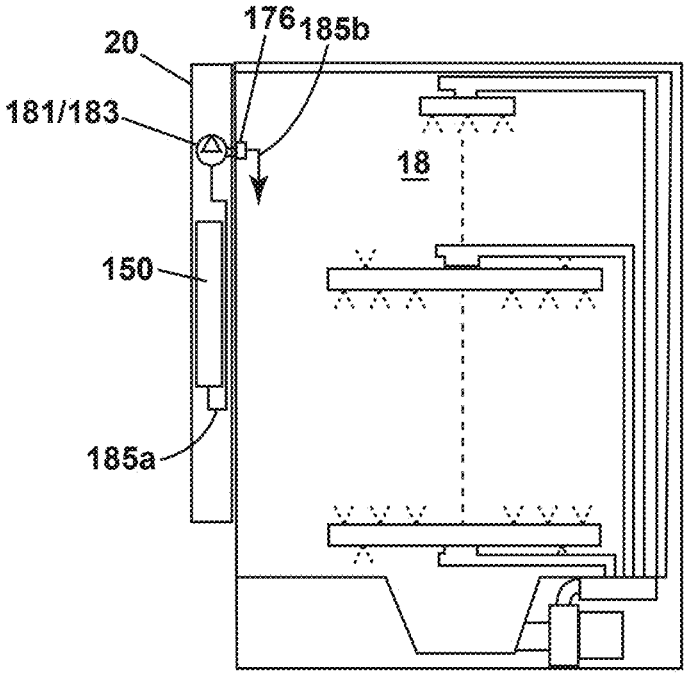
FIGS. 7A and 7B are schematic illustrations or remote pump and dispenser outlet locations in accordance with various aspects described herein.
Figure 7B:
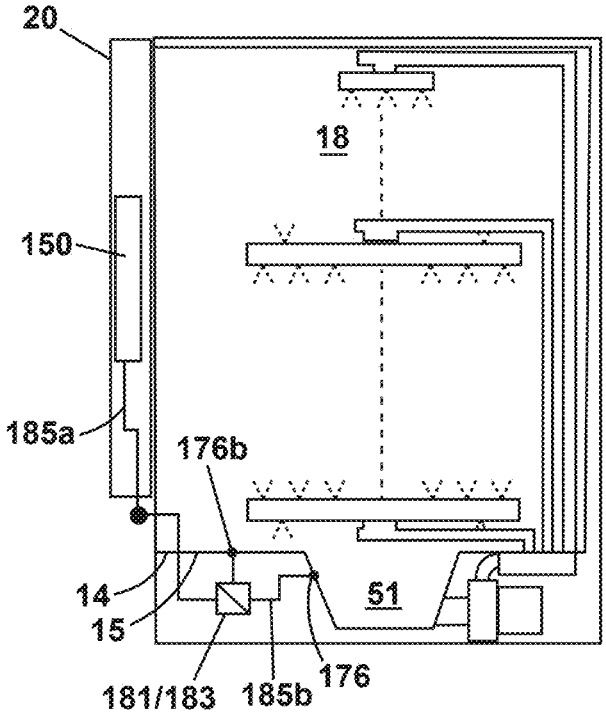

FIGS. 7A and 7B illustrate additional exemplary remote pump 181 and motor 183 locations with the dishwasher 10. In FIG. 7A it is contemplated that the one or more pumps 181 and/or the one or more motors 183 are positioned above the dispenser assembly 48 in the door assembly 20. In this illustration, the one or more pumps 181 and one or more motors 183 can be located or separately housed above the cartridge receptacle 150. The fluid conduits 185*a* can be made of flexible conduit and extend through the door assembly 20 to the one or more pumps 181. The fluid conduits 185*b* can extend to the fluid outlet 176, which can be positioned above the cartridge receptacle 150, or virtually anywhere in the dishwasher that dispenses to the treating chamber 18.

In FIG. 7B it is contemplated that the one or more pumps 181 and/or the one or more motors 183 are positioned beneath the dishwasher tub 14. The fluid conduits 185*a* can be made of flexible conduit and extend through the door assembly 20 or other portions to the dishwasher to reach the one or more pumps 181 located beneath the dishwasher tub 14. The fluid conduits 185*b* can be extended to the fluid outlet 176, which can be positioned in the tub surface including one of the sidewalls, floor of the tub 14, or into the sump 51. Once again, the position of the pumps 181 and/or motors 183 can be located in virtually any space or cavity of the dishwasher 10 and the dispenser outlet 186 can also be located virtually anywhere in the dishwasher that can dispense to the treating chamber 18. It should also be recognized that the dishwasher could contain more than one dispenser outlet 176 and chemistry from one chemistry reservoir (200, 202, 204) could be dispensed from one outlet 176 and chemistry from a second chemistry reservoir (200, 202, 204) could be dispensed to a second outlet 176*b*.

Aspects of the disclosure provide for several benefits, including that moving the motor and/or pump to a remote location from the dispenser assembly can potentially reduce exposer of the pumps and/or motors to wash liquid leaks if the dispenser assembly sealing system fails. Additionally, having the pumps and/or motors in a remote location from the dispenser assembly, allows for insulation to be provided around the cartridge assembly to thermally insulate the chemistries and/or detergents in the cartridge assembly from the temperature changes that occur during a wash cycle. Insulating the chemistries and/or detergents in the cartridge assembly from high wash cycle temperatures can help maintain the quality of chemistries and/or detergents and thereby, increase the number of wash cycles the dish treating appliance can run with chemistries in the cartridge assembly.

Further non-limiting aspects are provided by the subject matter of the following clauses:

A dish treating appliance for treating articles according to an automatic cycle of operation, the dish treating appliance comprising a chassis having an interior surface at least partially defining a treating chamber for receiving the articles for treatment according to the automatic cycle of operation, the chassis including a door assembly having an inner door surface forming part of the interior surface of the chassis, a dispenser assembly operably coupled to the interior surface comprising a cartridge receptacle defining a cartridge seat for carrying a cartridge assembly and at least one fluid coupling having a first end configured to couple to the cartridge, and at least one pump and at least one motor to drive the pump, the at least one pump and at least one motor disposed remote from the dispenser assembly, wherein the at least one pump is coupled to a second end of the fluid coupling for pumping detergent from the detergent cartridge into the treating chamber.

The dish treating appliance of the preceding clause wherein the cartridge assembly is positioned on the inner door surface.

The dish treating appliance of any of the preceding clauses wherein the at least one pump and at least one motor are positioned below the dispenser assembly in the door assembly.

The dish treating appliance of any of the preceding clauses wherein the at least one pump and at least one motor are positioned above the dispenser assembly.

The dish treating appliance of any of the preceding clauses wherein the at least one pump and at least one motor are positioned under the dishwasher tub.

The dish treating appliance of any of the preceding clauses wherein the cartridge assembly further comprises a plurality of chemistry chambers.

The dish treating appliance of any of the preceding clauses wherein each disaggregated chemistry chamber is in fluid communication with a pump and motor.

The dish treating appliance of any of the preceding clauses wherein each pump and motor is disposed remote from the dispenser assembly.

The dish treating appliance of any of the preceding clauses wherein the cartridge seat is spaced from a cartridge receptacle base wall forming a gap between the cartridge seat and the cartridge receptacle base wall.

The dish treating appliance of any of the preceding clauses further comprising insulation filling the gap.

The dish treating appliance of any of the preceding clauses further comprising a dispenser outlet positioned remote from the dispenser assembly and remote from the one or more pumps and motors.

The dish treating appliance of any of the preceding clauses wherein the dispenser outlet is positioned above the dispenser assembly.

The dish treating appliance of any of the preceding clauses wherein the dispenser outlet is positioned in the sump of the dish treating appliance.

The dish treating appliance of any of the preceding clauses the dispenser assembly is positioned on an inner surface of door assembly and the dispenser outlet is positioned on the interior surface forming the treating chamber other than of the inner surface of door assembly.

A dish treating appliance for treating articles according to an automatic cycle of operation, the dish treating appliance comprising a chassis having an interior surface at least partially defining a treating chamber for receiving the articles for treatment according to the automatic cycle of operation, the chassis including a door assembly having an inner door surface forming part of the interior surface of the chassis, a dispenser assembly operably coupled to the interior surface comprising a cartridge receptacle defining a cartridge seat for carrying a cartridge assembly and at least one fluid coupling having a first end configured to couple to the cartridge, and a dispenser outlet positioned in a location remote from the dispenser assembly.

The dish treating appliance of the preceding clause further comprising at least one pump and one motor to drive the pump, the at least one pump and at least one motor disposed remote from the dispenser assembly.

The dish treating appliance of any of the preceding clauses wherein the dispenser outlet is positioned above the dispenser assembly.

The dish treating appliance of any of the preceding clauses wherein the dispenser outlet is positioned in the sump of the dish treating appliance.

The dish treating appliance of any of the preceding clauses the dispenser assembly is positioned on an inner surface of door assembly and the dispenser outlet is positioned on the interior surface forming the treating chamber other than of the inner surface of door assembly.

The dish treating appliance of any of the preceding clauses further comprising insulation in a gap formed between the cartridge seat and a cartridge receptacle base wall.

What is claimed is:

1. A dish treating appliance for treating articles according to an automatic cycle of operation, the dish treating appliance comprising:

a chassis having an interior surface at least partially defining a treating chamber for receiving the articles for treatment according to the automatic cycle of operation, the chassis including a door assembly having an inner door surface forming part of the interior surface of the chassis;

a dispenser assembly operably coupled to the interior surface comprising a cartridge receptacle defining a cartridge seat for carrying a cartridge assembly and at least one fluid coupling having a first end configured to couple to the cartridge; and at least one pump and at least one motor to drive the pump, the at least one pump and at least one motor disposed remote from the dispenser assembly, wherein the at least one pump is coupled to a second end of the fluid coupling for pumping detergent from the detergent cartridge into the treating chamber.

2. The dish treating appliance of claim 1, wherein the cartridge assembly is positioned on the inner door surface.

3. The dish treating appliance of claim 2, wherein the at least one pump and at least one motor are positioned below the dispenser assembly in the door assembly.

4. The dish treating appliance of claim 2, wherein the at least one pump and at least one motor are positioned above the dispenser assembly.

5. The dish treating appliance of claim 2, wherein the at least one pump and at least one motor are positioned under the dishwasher tub.

6. The dish treating appliance of claim 1, wherein the cartridge assembly further comprises a plurality of chemistry chambers.

7. The dish treating appliance of claim 6, wherein each chemistry chamber is in fluid communication with a pump and motor.

8. The dish treating appliance of claim 7, wherein each pump and motor is disposed remote from the dispenser assembly.

9. The dish treating appliance of claim 1, wherein the cartridge seat is spaced from a cartridge receptacle base wall forming a gap between the cartridge seat and the cartridge receptacle base wall.

10. The dish treating appliance of claim 9, further comprising insulation filling the gap.

11. The dish treating appliance of claim 1, further comprising a dispenser outlet positioned remote from the dispenser assembly and remote from the one or more pumps and motors.

12. The dish treating appliance of claim 11, wherein the dispenser outlet is positioned above the dispenser assembly.

13. The dish treating appliance of claim 11, wherein the dispenser outlet is positioned in the sump of the dish treating appliance.

14. The dish treating appliance of claim 11, wherein the dispenser assembly is positioned on an inner surface of the door assembly and the dispenser outlet is positioned on the interior surface forming the treating chamber other than of the inner surface of the door assembly.

15. A dish treating appliance for treating articles according to an automatic cycle of operation, the dish treating appliance comprising:

a chassis having an interior surface at least partially defining a treating chamber for receiving the articles for treatment according to the automatic cycle of operation, the chassis including a door assembly having an inner door surface forming part of the interior surface of the chassis;

a dispenser assembly operably coupled to the interior surface comprising a cartridge receptacle defining a cartridge seat for carrying a cartridge assembly and at least one fluid coupling having a first end configured to couple to the cartridge; and a dispenser outlet positioned in a location remote from the dispenser assembly.

16. The dish treating appliance of claim 15, further comprising at least one pump and one motor to drive the pump, the at least one pump and at least one motor disposed remote from the dispenser assembly.

17. The dish treating appliance of claim 15, wherein the dispenser outlet is positioned above the dispenser assembly.

18. The dish treating appliance of claim 15, wherein the dispenser outlet is positioned in the sump of the dish treating appliance.

19. The dish treating appliance of claim 15, wherein the dispenser assembly is positioned on an inner surface of the door assembly and the dispenser outlet is positioned on the interior surface forming the treating chamber other than of the inner surface of the door assembly.

20. The dish treating appliance of claim 15, further comprising insulation in a gap formed between the cartridge seat and a cartridge receptacle base wall.

* * * * *